US009080467B2

(12) United States Patent
Brückner et al.

(10) Patent No.: US 9,080,467 B2
(45) Date of Patent: Jul. 14, 2015

(54) METHOD FOR REGULATING A BRIEF INCREASE IN POWER OF A STEAM TURBINE

(75) Inventors: Jan Brückner, Uttenreuth (DE); Martin Effert, Erlangen (DE); Frank Thomas, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 137 days.

(21) Appl. No.: 14/001,281

(22) PCT Filed: Feb. 10, 2012

(86) PCT No.: PCT/EP2012/052312
§ 371 (c)(1), (2), (4) Date: Aug. 23, 2013

(87) PCT Pub. No.: WO2012/113662
PCT Pub. Date: Aug. 30, 2012

(65) Prior Publication Data

US 2013/0327043 A1 Dec. 12, 2013

(30) Foreign Application Priority Data

Feb. 25, 2011 (DE) ..... 10 2011 004 712

(51) Int. Cl.

| | |
|---|---|
| ***F01K 13/02*** | (2006.01) |
| ***F22D 11/00*** | (2006.01) |
| ***F22B 35/10*** | (2006.01) |
| ***F22G 5/12*** | (2006.01) |
| ***F22G 5/02*** | (2006.01) |

(52) U.S. Cl.
CPC ..... *F01K 13/02* (2013.01); *F22B 35/10* (2013.01); *F22D 11/00* (2013.01); *F22D 11/003* (2013.01); *F22G 5/02* (2013.01); *F22G 5/12* (2013.01)

(58) Field of Classification Search
CPC ..... F01K 13/02; F22D 11/003; F22D 11/00; F22G 5/02; F22G 5/12; F22B 35/10
USPC ..... 60/646, 657, 665, 667
See application file for complete search history.

(56) References Cited

U.S. PATENT DOCUMENTS

| | | | | |
|---|---|---|---|---|
| 3,828,737 | A | 8/1974 | Fujii | |
| 5,529,021 | A | 6/1996 | Butterlin | |
| 6,230,480 | B1 * | 5/2001 | Rollins, III | 60/39.182 |
| 6,301,895 | B1 | 10/2001 | Kallina | |
| 8,453,452 | B2 * | 6/2013 | Kravets | 60/653 |
| 2012/0151926 | A1 * | 6/2012 | Labbe | 60/670 |
| 2012/0255303 | A1 * | 10/2012 | Labbe | 60/653 |

FOREIGN PATENT DOCUMENTS

| | | | |
|---|---|---|---|
| CN | 1619110 | A | 5/2005 |
| DE | 4117796 | A1 | 1/1993 |
| DE | 19750125 | A1 | 3/1999 |
| EP | 0308728 | B1 | 6/1991 |
| EP | 1030960 | B1 | 8/2002 |
| FR | 2401380 | A1 | 3/1979 |
| JP | 2013543574 | A | 12/2013 |
| WO | WO 2009150055 | A2 | 12/2009 |

* cited by examiner

*Primary Examiner* — Hoang Nguyen

(57) ABSTRACT

A method is provided for regulating a brief increase in power of a steam turbine that has an upstream fossil-fired once-through steam generator having a plurality of economizer, evaporator and superheater heating surfaces which form a flow path and through which a flow medium flows. The flow of the flow medium through the fossil-fired once-through steam generator is increased in order to achieve the brief increase in power of the steam turbine. The method involves using desired enthalpy value at the outlet of an evaporator heating surface as a control variable for determining a desired value for the flow of the flow medium through the fossil-fired once-through steam generator. The desired enthalpy value is reduced in order to achieve the brief increase in power of the steam turbine.

6 Claims, 2 Drawing Sheets

METHOD FOR REGULATING A BRIEF INCREASE IN POWER OF A STEAM TURBINE

CROSS REFERENCE TO RELATED APPLICATIONS

This application is the US National Stage of International Application No. PCT/EP2012/052312 filed Feb. 10, 2012 and claims benefit thereof, the entire content of which is hereby incorporated herein by reference. The International Application claims priority to the German application No. 102011004712.3 DE filed Feb. 25, 2011, the entire contents of which is hereby incorporated herein by reference.

FIELD OF INVENTION

The invention relates to a method for regulating a brief increase in power of a steam turbine that has an upstream fossil-fired once-through steam generator featuring a number of economizer, evaporator and superheater heating surfaces which form a flow path and through which a flow medium flows.

BACKGROUND OF INVENTION

A fossil-fired steam generator generates superheated steam using the heat that is generated by combustion of fossil fuels. Fossil-fired steam generators are mainly used in steam power plants, which are primarily used to generate electricity. The generated steam is supplied to a steam turbine in this case.

In a similar way to the various pressure stages of a steam turbine, the fossil-fired steam generator also comprises a plurality of pressure stages featuring different thermal states of the water-steam mixture which is contained in each case. In the first (high) pressure stage, the flow medium on its flow path is carried firstly through economizers, which use the residual heat to preheat the flow medium, and then through various stages of evaporator and superheater heating surfaces. In the evaporator, the flow medium is evaporated, after which any residual moisture is separated off in a separating device and the remaining steam is heated up further in the superheater. The superheated steam then flows into the high-pressure part of the steam turbine, where it is expanded and supplied to the subsequent pressure stage of the steam generator. There it is superheated again (intermediate superheater) and supplied to the next pressure part of the steam turbine.

Due to all manner of external influences, the heat output transferred to the superheater can fluctuate significantly. It is therefore often necessary to regulate the superheating temperature. This is usually achieved by means of an injection of feed-water for the purpose of cooling before or after individual superheater heating surfaces, i.e. an overflow line branches off from the main flow of the flow medium and leads to injection coolers disposed there accordingly. The injection is usually regulated by means of fixtures in this case, using a reference value that is characteristic of the temperature deviations from a predetermined desired temperature value at the outlet of the superheater.

Modern power plants are expected to deliver not only high levels of efficiency, but also maximal flexibility of operation. In addition to short start-up times and rapid load changes, this also includes the ability to compensate for frequency disruptions in the power grid. In order to meet these requirements, the power plant must be capable of supplying power increases of e.g. 5% and more relative to full power within a few seconds.

Such changes in power within a period of seconds from a power plant block can only be achieved by means of coordinated interaction between steam generator and steam turbine. The contribution which the fossil-fired steam generator can make to this consists in the use of its stores, i.e. the steam store and the fuel store, and in rapid changes of the actuating variables for feed-water, injection water, fuel and air.

This can be done by opening partially throttled turbine valves of the steam turbine or a so-called step valve, for example, thereby decreasing the steam pressure ahead of the steam turbine. Steam from the steam store of the upstream fossil-fired steam generator is therefore withdrawn and supplied to the steam turbine. This measure results in a power increase within a few seconds.

This additional power can be released in a relatively short time, making it possible at least in part to compensate for the delayed increase in power that is produced by the increase in furnace output. The power of the whole block is immediately boosted as a result of this measure, and can be continuously maintained or exceeded by increasing the furnace output thereafter, provided the installation was in the partial load range at the time the additional power reserves were demanded.

However, permanent throttling of the turbine valves in order to maintain a reserve always results in a loss of efficiency and therefore, in order to ensure cost-effective operation, the extent of throttling should be kept as low as is absolutely necessary. Furthermore, some design formats of fossil-fired steam generators, e.g. once-through flow boilers, may have a significantly smaller storage volume than e.g. natural circulation boilers. In the method described above, the difference in the size of the store has an influence on the response to power changes of the power plant block. Moreover, particularly in the upper load range, the design pressure in the overall steam generator must not be exceeded as a result of throttling, and therefore this measure can only be applied to a limited extent or even not at all in the upper load range.

SUMMARY OF INVENTION

The object of the invention is therefore to specify a method for regulating a brief increase in power of a steam turbine, which method is particularly suitable for achieving a brief increase in power of a downstream steam turbine without thereby excessively impairing the efficiency of the steam process.

This object is achieved according to the invention by increasing the flow of the flow medium through the fossil-fired steam generator in order to provide a brief increase in power of the steam turbine.

The invention is based on the idea that heat output which is introduced into the steam generator is determined by the furnace output, and only takes effect comparatively slowly in the case of a sudden change. An additional release of power in the steam turbine should therefore be effected by utilizing the heat energy that is stored in the heating surfaces of the steam generator. The withdrawal of this heat requires a drop in the average material temperature. This is to be achieved by an increase in the flow, i.e. the quantity of flow medium which flows through per time unit. By virtue of this measure, as a result of the increased throughput with comparatively low flow medium temperatures, the average material temperature of all heating surfaces is reduced and consequently thermal energy is withdrawn from all of these heating surfaces and released in the steam turbine in the form of additional power.

In an advantageous embodiment, in order to achieve a brief increase in power of the steam turbine, the desired enthalpy value at the outlet of an evaporator heating surface is reduced. The desired value for the specific enthalpy is used in the control system of the steam generator as a control variable for determining the desired value for the flow of the flow medium. This alteration measure has two effects: firstly, the basic desired value of the evaporator throughput, as calculated when determining the desired feed-water value, increases. Secondly, the enthalpy correction regulator increases its output signal on the basis of a control deviation which is now larger, especially if the reduction takes place particularly quickly (suddenly), in order to reduce the enthalpy at the evaporator outlet as quickly as possible. The quantity of feed-water therefore increases even more than proportionally at the beginning of this measure, and particularly rapid withdrawal of heat from the heating surfaces with the associated release of power in the steam turbine is possible.

The desired enthalpy value is advantageously reduced to a predetermined minimum enthalpy value. This ensures a maximal release of power under all load conditions while maintaining operational safety at the same time.

In a particularly advantageous embodiment, the minimum enthalpy value is measured in such a way that complete evaporation of the flow medium is achieved in the evaporator heating surfaces under all load conditions of the fossil-fired steam generator. It should be ensured, particularly in subcritical operation, that the enthalpy at the evaporator outlet is not reduced too far, such that an accumulation of residual water in a downstream separating device can be reliably avoided. It is thus possible to achieve a maximal increase in additional feed-water and hence in additional power released, at the same time as maximal operational safety.

It must be emphasized in this case that the higher the actual enthalpy selected at the evaporator outlet during steady-state operation, i.e. the greater the deviation from the fixed predetermined minimal enthalpy, the more thermal energy can be withdrawn, i.e. the more steam turbine power can be briefly generated. In the case of a boiler layout that is customized for this measure, the greatest possible deviation from the minimal enthalpy in the steady-state operation and/or in the frequency backup operation is therefore preferred. Under the circumstances cited above, it must however be taken into consideration in this case that excessively unbalanced temperature conditions at the evaporator outlet can only be avoided by means of a suitable boiler design. Moreover, the layout or the existing steam generator design must also allow for the transient loads which occur and can lead to a corresponding material fatigue depending on magnitude and frequency. It should however be noted here that during supercritical steam generator operation in particular, when the greatest possible reduction in the evaporator outlet enthalpy can be achieved, only moderate temperature reductions can be expected at the evaporator outlet due to the water-steam properties of the flow medium, and the material stresses on the evaporator are therefore limited accordingly.

The parameters of the applied measures are advantageously adapted to and optimized for the release of power that is required in the steam turbine. For this purpose, the magnitude and/or duration of the reduction in the desired enthalpy value are determined with reference to the required increase in power.

In an alternative or additional advantageous embodiment, in order to achieve the brief increase in power of the steam turbine, flow medium taken from the flow path is injected in the region of a superheater heating surface of the steam generator. Specifically, such injections can further assist the provision of a brief and rapid power change. The steam mass flow can indeed be temporarily increased by means of this additional injection in the region of the superheater. According to the invention, the stored thermal energy is likewise used to provide a temporary increase in power of the steam turbine. This offers the additional advantage that a particularly significant power reserve can be maintained at a constant level, both quickly and for as long as possible, by coordinating of all of the available measures in an appropriate manner. The material stresses can also be positively influenced by staggering the individual measures.

In a further advantageous embodiment, the heat supply to the fossil-fired steam generator is increased, i.e. the furnace output of the burners is increased. Consequently, the described method can positively influence or even completely prevent a temperature drop at the evaporator outlet, since the measure acts as a derivative-action signal on the feed-water. Therefore the method not only allows a brief increase in power, but can also be used to more rapidly select a longer lasting increase in power.

In an advantageous embodiment, a control system for a fossil-fired steam generator featuring a number of economizer, evaporator and superheater heating surfaces which form a flow path and through which a flow medium flows, comprises means for executing the method. In a further advantageous embodiment, a fossil-fired steam generator for a steam power plant comprises such a control system, and a steam power plant comprises such a fossil-fired steam generator.

The invention offers the particular advantages that the brief increase in the quantity of feed-water allows a particularly rapid release of power in the steam turbine downstream of the steam generator by using the heat energy that is stored in all of the heating surfaces. Furthermore, this measure can be implemented without invasive structural measures and involves only minimal modifications to the feed-water control model, such that no additional costs are incurred despite a significant increase in the flexibility of the installation.

In comparison with using the injections as a power increasing measure, it is moreover also possible to access the stored thermal energy of the economizer, the evaporator and the first superheater heating surfaces, these being situated upstream of the first injection on the flow medium side, as an additional energy source. Consequently, a considerably larger reservoir of stored thermal energy is available for the additional power requirement. It is therefore possible either to generate a greater power increase (peak) or to maintain an additional release of power at a lower level for longer.

In the upper load range in particular, where e.g. throttling of the turbine valves must be limited to a specific level in order that the maximal design pressure in the high-pressure part is not exceeded, the described method can be used to ensure a higher power reserve if necessary. And the advantages of this measure are particularly valid in precisely the upper load range, since the temperature changes at the evaporator outlet here vary within acceptable limits as a result of the water-steam properties of the flow medium.

BRIEF DESCRIPTION OF THE DRAWINGS

An exemplary embodiment of the invention is explained with reference to a drawing, in which.

DETAILED DESCRIPTION OF INVENTION

Figure 1:
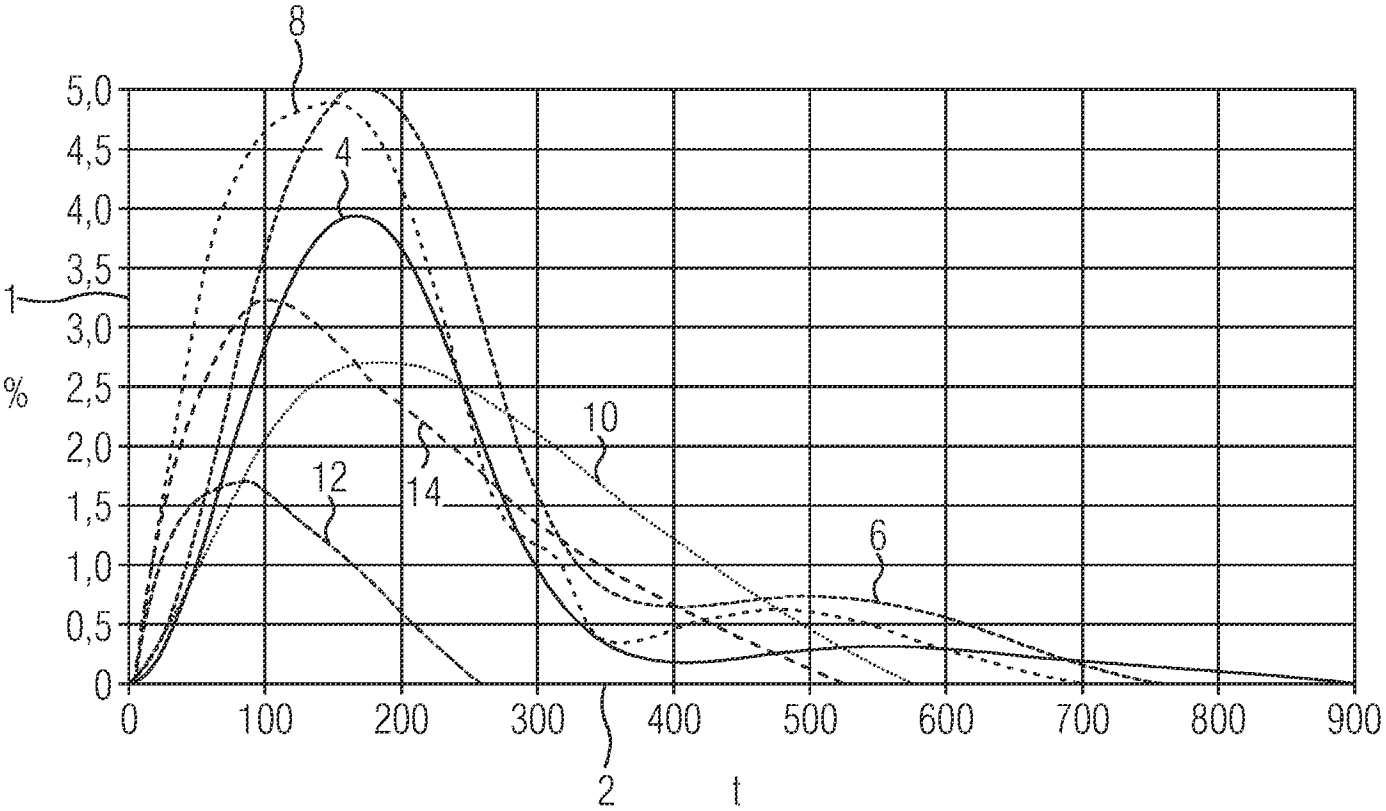
FIG. 1 shows a diagram containing simulation results for improving the immediate reserve of a fossil-fired once-through steam generator by increasing the feed-water quantity in conjunction with the injection of high-pressure steam and intermediate superheated steam in relation to an upper load range in both pressure systems.

Identical parts are denoted by the same reference characters in all of the figures.

FIG. 1 shows a diagram containing simulation results using the regulating method in a fossil-fired steam generator, i.e. an abrupt reduction in the desired enthalpy value at the evaporator outlet for the purpose of increasing the feed-water quantity in the context of a constant furnace output. The percental additional power relative to full load 1 is plotted over the time 2 in seconds following an abrupt reduction in the desired value of the specific enthalpy at the evaporator outlet of 100 kJ/kg at 95% loading. In the control model, this reduction produces an increase in the feed-water flow quantity. Graph curve 4 shows the result without additional use of injections, while graph curves 6 and 8 illustrate the results in respect of an additional use of injections in the high-pressure stage or in the high-pressure and medium-pressure stages. Further graph curves 10, 12, 14 are illustrated for the purpose of comparison, and show the results that are obtained without increasing the feed-water quantity but using only the injections in the high-pressure stage (graph curve 10), medium-pressure stage (graph curve 12) and both pressure stages (graph curve 14). In this case, the injection is achieved by reducing the desired value for live steam temperature and possibly for intermediate superheating temperature by 20 K.

It is evident from FIG. 1 that the maxima of the graph curves 4, 6 and 8 are higher than those of the graph curves 10, 12 and 14. The additionally released power is therefore higher. In particular, a combination of the measures in respect of feed-water and injections shows a significant increase in power (graph curves 6, 8). However, graph curve 4 already shows that, assuming the high load in FIG. 1, the increase in the feed-water flow shows the greatest power yield of all individual measures (cf. the graph curves 10, 12, 14). However, the use of injections results in an even faster provision of additional power, as shown by the peaks of the corresponding graph curves situated further to the left in the graph.

Figure 2:
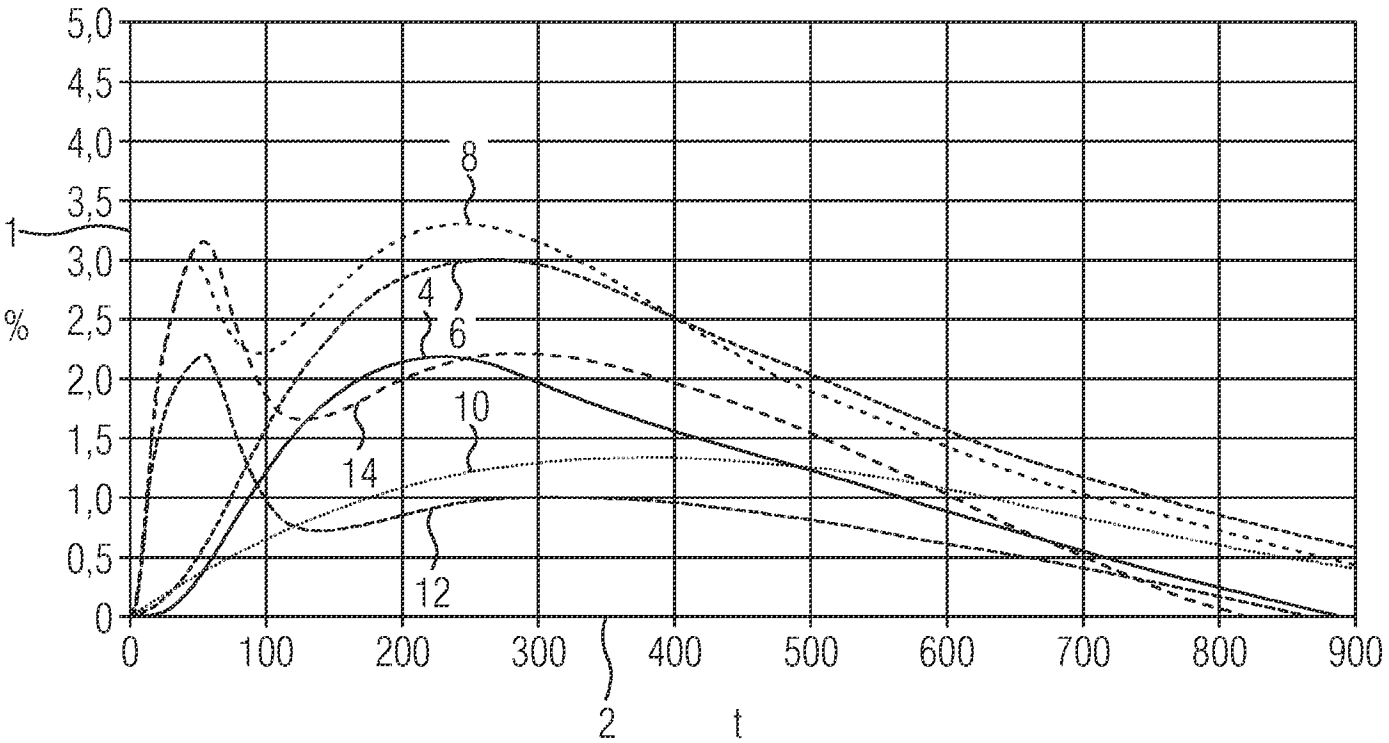
FIG. 2 shows a diagram containing simulation results for improving the immediate reserve of a fossil-fired once-through steam generator by increasing the feed-water quantity in conjunction with the injection of high-pressure steam and intermediate superheated steam in relation to a lower load range in both pressure systems.

FIG. 2 is only slightly modified relative to FIG. 1 and shows the simulated graph curves 4, 6, 8, 10, 12, 14 for a 40% load, wherein all remaining parameters correspond to those in FIG. 1, as does the function of the graph curves 4, 6, 8, 10, 12, 14. In particular, the graph curves 4, 6, 10 here show a considerably flatter profile than those in FIG. 1, signifying a slower increase in power at a lower level. Likewise, the power reserve is less influenced by the increase in feed-water flow, though it remains significant.

Only the modification of the intermediate superheating (graph curve 12) produces a comparatively high power increase approximately 60 seconds after the desired value is changed, dropping off quickly again thereafter and merging into the maximum of the flat profile. This power increase is also correspondingly evident if both pressure stages are modified as per graph curves 8 and 14. However, it is evident in all cases that the increase in power resulting from an increase in the feed-water quantity allows the greatest power yield over a longer duration, this effect being particularly pronounced in the upper load range.

The invention claimed is:

1. A method for regulating a brief increase in power of a steam turbine that has an upstream fossil-fired once-through steam generator comprising a plurality of economizer, evaporator and superheater heating surfaces which form a flow path and through which a flow medium flows, the method comprising:

increasing the flow of the flow medium through the fossil-fired once-through steam generator in order to achieve the brief increase in power of the steam turbine, using a desired enthalpy value at the outlet of an evaporator heating surface as a control variable for determining a desired value for the flow of the flow medium through the fossil-fired once-through steam generator, and reducing the desired enthalpy value in order to achieve the brief increase in power of the steam turbine.

2. The method as claimed in claim 1, wherein the desired enthalpy value is reduced to a predetermined minimum enthalpy value.

3. The method as claimed in claim 2, wherein the minimum enthalpy value is dimensioned in such a way that complete evaporation of the flow medium in the evaporator heating surfaces is achieved under all load conditions of the fossil-fired once-through steam generator.

4. The method as claimed in claim 1, wherein the magnitude and/or duration of the reduction in the desired enthalpy value is determined with reference to the required increase in power.

5. The method as claimed in claim 1, wherein in order to achieve the brief increase in power of the steam turbine, flow medium taken from the flow path is injected in the region of a superheater heating surface of the fossil-fired once-through steam generator.

6. The method as claimed in claim 1, wherein the heat supply to the fossil-fired once-through steam generator is increased.

* * * * *